US008797126B2

(12) United States Patent
Gevorgyan et al.

(10) Patent No.: US 8,797,126 B2
(45) Date of Patent: Aug. 5, 2014

(54) TUNABLE MICROWAVE ARRANGEMENTS

(75) Inventors: Spartak Gevorgyan, Goteborg (SE); Anatoli Deleniv, Molndal (SE); Thomas Lewin, Onsala (SE); Per Ligander, Goteborg (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 519 days.

(21) Appl. No.: 13/131,328

(22) PCT Filed: Dec. 1, 2008

(86) PCT No.: PCT/EP2008/066526
§ 371 (c)(1),
(2), (4) Date: May 26, 2011

(87) PCT Pub. No.: WO2010/063307
PCT Pub. Date: Jun. 10, 2010

(65) Prior Publication Data

US 2011/0227674 A1 Sep. 22, 2011

(51) Int. Cl.
*H01P 3/00* (2006.01)
*H01P 3/12* (2006.01)
*H01P 9/00* (2006.01)

(52) U.S. Cl.
CPC ..... *H01P 3/121* (2013.01); *H01P 3/12* (2013.01); *H01P 9/00* (2013.01)
USPC ..... 333/239; 333/248; 333/253; 333/209

(58) Field of Classification Search
USPC ..... 333/208, 239, 248, 253
See application file for complete search history.

(56) References Cited

U.S. PATENT DOCUMENTS

| | | | | |
|---|---|---|---|---|
| 5,821,836 | A | 10/1998 | Katehi et al. | |
| 7,456,711 | B1 | 11/2008 | Goldsmith | |
| 2005/0270125 | A1 | 12/2005 | Higgins et al. | |
| 2006/0065916 | A1 * | 3/2006 | Zhang et al. | 257/295 |

OTHER PUBLICATIONS

Daisuke Koizumi, Kei Satoh, and Shoichi Narahashi, A 5-GHz Band Coplanar-Waveguide High Temperature Superconducting Filter Employing T-Form Open Gap, 15th ieee international symposium on the applications of ferroelectrics, 2006. isaf '06. p. 583.*

Boutejdar, et al., "A new compact tunable bandpass filter using defected ground structure with active devices", Antennas and Propagation Society International Symposium, IEEE, 2008, pp. 1-4, XP031342504.

Hao Xin, et al., "Tunable millimeter-wave band-stop filter using electromagnetic crystal (EMXT) surfaces", IEEE, vol. 2, Jun. 2003, pp. 1107-1110, XP010649974.

* cited by examiner

*Primary Examiner* — Stephen Jones
*Assistant Examiner* — Scott S Outten
(74) *Attorney, Agent, or Firm* — Rothwell, Figg, Ernst & Manbeck PC

(57) ABSTRACT

The present invention relates to a tunable microwave arrangement (100) comprising a waveguide arrangement and tuning elements comprising a number of varactors for tuning an electromagnetic signal input to the waveguide arrangement. It comprises a substrate (1), a layered structure (20) comprising at least two conducting layers (2,3) and at least one dielectric layer (4) which are arranged in an alternating manner. The layered structure is arranged on the substrate (1) such that a first of said conducting layers (2) is closest to the substrate (1). It also comprises at least one surface mounted waveguide (5), a second of the conducting layers (3), most distant from the substrate, being adapted to form a wall of the surface mounted waveguide (5), which wall incorporates said tuning elements which are arranged to enable control of surface currents generated in said wall, hence loading the waveguide (5) with a tunable, controllable impedance.

11 Claims, 9 Drawing Sheets

TUNABLE MICROWAVE ARRANGEMENTS

CROSS-REFERENCE TO RELATED APPLICATION(S)

This application is a 35 U.S.C. §371 National Phase Entry Application from PCT/EP2008/066526, filed Dec. 1, 2008, and designating the United States, the disclosure of which is incorporated herein in its entirety by reference.

TECHNICAL FIELD

The present invention relates to tunable microwave arrangements comprising a waveguide arrangement and tuning elements, wherein the tuning elements consist of a number of varactors for tuning electromagnetic waves input to the waveguide arrangement. The invention also relates to a method for providing such tunable microwave arrangements.

BACKGROUND

For microwave systems in general tunable arrangements or components are of great importance. As examples of tunable arrangements can be mentioned resonators, filters, phase shifters and antennas. Particularly important are tunable components or arrangements for agile microwave systems. Typically the tunable components are implemented in the form of lumped inductors and capacitors (so called lumped LC devices) and sections of transmission lines where varactors (controllable capacitors) are used as tuning means. The varactors can be of many different kinds. For example micro-electro-mechanical varactors (MEM), alternatively semiconductor varactors, for example consisting of p-n junctions, MOS (Metal Oxide Semiconductors) varactors etc. The varactors may also be ferroelectric. Typically the varactors, the sections of the transmission lines and the LC devices are arranged as hybrid, monolithic integrated circuits wherein the lumped and distributed elements have microstrip, stripline or a coplanar structure. In order to increase the quality factor while still keeping the fabrication costs low, it has been suggested to use hollow waveguides as surface mounted components.

It is however a problem with such arrangements, comprising a tunable resonator and other integrated components which are based on lumped LC elements and sections of microstrip, coplanar waveguide and striplines, that they are associated with relatively high losses. This is mainly due to currents being highly concentrated in thin and narrow metal strips and since currents are concentrated in open structures which then will radiate. Even if surface mounted waveguides have smaller losses than other types of integrated waveguides, it is difficult to electronically tune the parameters of the electromagnetic waves travelling in such waveguides without a substantial reduction of the quality factor (Q-factor). It is also difficult to keep the fabrication costs low.

SUMMARY

It is an object of the present invention to provide improved tunable microwave arrangements which are cheap and easy to fabricate and which at the same time do not suffer from high losses. It is another object to provide microwave arrangements which can be electronically tuned, without any substantial reduction of the quality (Q) factor. Particularly it is an object to facilitate electronic tuning of microwave arrangements. It is also an object of the invention to provide a method for fabrication of such tunable microwave arrangements.

Therefore, to solve one or more of these problems, a tunable microwave arrangement which comprises a waveguide arrangement and tuning elements consisting of varactors is provided. It comprises a substrate and a layered structure. The layered structure comprises at least two conducting layers and at least one dielectric layer which are arranged in an alternating manner. The layered structure is disposed on the substrate in such a manner that a first conducting layer is located closest to the substrate. The waveguide arrangement also comprises one or more surface mounted waveguides. A conducting layer which is disposed most distant, or furthest away, from the substrate is adapted to form a wall of the surface mounted waveguide. This waveguide wall is adapted to incorporate or assist in forming the tuning elements. The tuning elements are arranged to control, or to influence, surface currents which are generated in the wall and therefore load the waveguide with an impedance which is tunable or controllable.

A method for providing such a tunable microwave arrangement is also provided. According to the method a layered structure is provided which comprises two or more conducting layers and at least one dielectric layer. The layered structure is provided on a substrate in such a manner that one of the conducting layers is disposed close to, or on, the substrate. In another of the conducting layers, the one which is located most far away from the conducting layer placed on the substrate, tuning elements are integrated or provided. A waveguide arrangement is mounted on a surface which is formed by the distant conducting layer in such a manner that this distant layer will form a wall of the surface mounted waveguide. In order to tune electromagnetic waves input to and propagating through the waveguide arrangement, a tuning voltage can be applied to the layered structure. The tuning elements in the wall will cut the lines of surface currents which are generated in the wall by an input electromagnetic signal.

It is an advantage of the invention that microwave arrangements can be provided which are cheap and easy to fabricate and at the same time have a high performance. It is also an advantage that surface mounted components can be tuned, i.e. that the parameters of electromagnetic waves travelling in such waveguides can be electronically tuned substantially without affecting or reducing the Q-factor.

BRIEF DESCRIPTION OF THE DRAWINGS

The invention will in the following be further described, in a non-limiting manner, and with reference to the accompanying drawings, in which.

DETAILED DESCRIPTION

Figure 1:
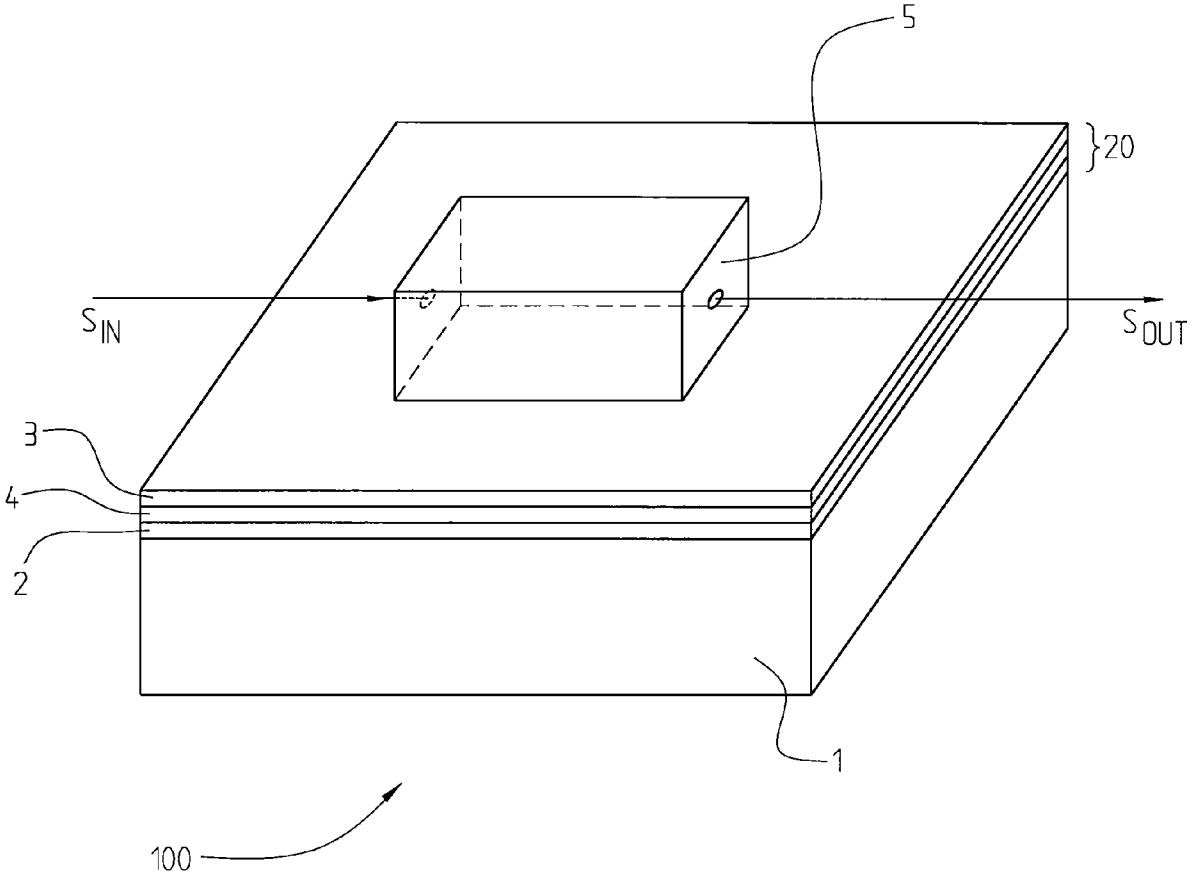
FIG. 1 illustrates a tunable arrangement comprising a surface mounted waveguide according to a first embodiment.

FIG. 1 shows a microwave arrangement 100. It comprises a substrate 1 which may consist of a printed circuit board (PCB), for example FR-4 (Flame Reterdant 4) or similar, or be a substrate of silicon (SiGe), GaAs or similar. On the substrate 1 a layered structure 20 is disposed. The layered structure 20 here comprises a first, also called proximate, conducting layer and a second, distant, conducting layer 3. Between the conducting layers 2, 3 a dielectric layer 4 is provided. The dielectric layer 4 comprises a complex metal oxide, e.g. a liquid crystal, a ferroelectric or a pyrochlore complex oxide. The distant conducting layer 3 is preferably pre-patterned to have areas forming or comprising tuning elements (not shown). Also the first, proximate, conducting layer 2 may be prepatterned. The dielectric layer 4 comprising a complex metal oxide may also be pre-patterned, particularly at least in areas corresponding to the pre-patterned areas forming or comprising the tuning elements in the conducting layer 3 or layers. The dielectric permittivity of the dielectric layer 4 is tunable by means of application of an electric field.

On top of the layered structure, a surface mounted waveguide 5 is attached to the distant or top conducting layer 3. The conducting layer 3 will serve as a bottom wall of the waveguide 5. In an advantageous embodiment the surface mounted waveguide 5 is hollow. In other embodiments it is not hollow. It may for example comprise a dielectricum with metallized sides or surfaces except for the one which is disposed on the conducting layer 3. The dielectricum is then preferably a low loss dielectricum.

$S_{IN}$, $S_{OUT}$ in FIG. 1 illustrate input and output of an electromagnetic signal. It is coupled in/out by means of coupling means which may comprise loops, probes or irises in a conventional manner. The coupling means are connected to the waveguide.

Figure 2:
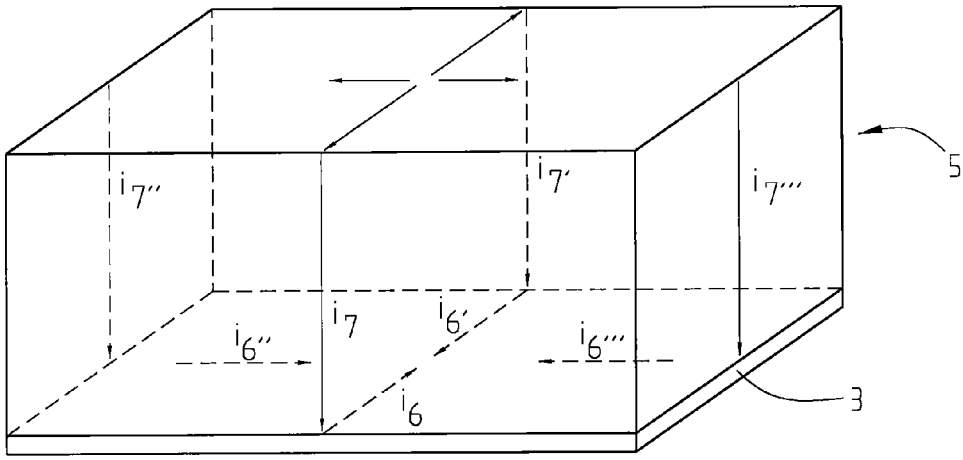
FIG. 2 is a larger scale illustration of a surface mounted waveguide showing currents generated in the walls of the waveguide due to the input of a microwave signal.

FIG. 2 schematically illustrates a hollow waveguide resonator 5 for which a conducting layer 3 acts as bottom wall. In the figure are shown the currents generated by an input electromagnetic signal. The hollow waveguide 5 is here rectangular; it should be clear that the invention is not limited to the surface mounted waveguide having any particular shape, it may also be square shaped, circular or have any other appropriate shape.

In the bottom wall of the surface mounted waveguide 5, i.e. the top conducting layer 3, slots are provided as will be more thoroughly explained with reference to FIG. 3. Input/output coupling means are not shown in FIG. 2 but, as referred to above, input/output coupling may be provided by means of probes or loops, irises etc. When a microwave signal is input, surface currents are generated. They flow from the top wall towards the centre of the bottom wall 3 along the vertical walls $I_7$, $I_{7'}$, $I_{7''}$, $I_{7'''}$, $i_6$, $i_{6'}$, $i_{6''}$, $i_{6'''}$.

Figure 3:
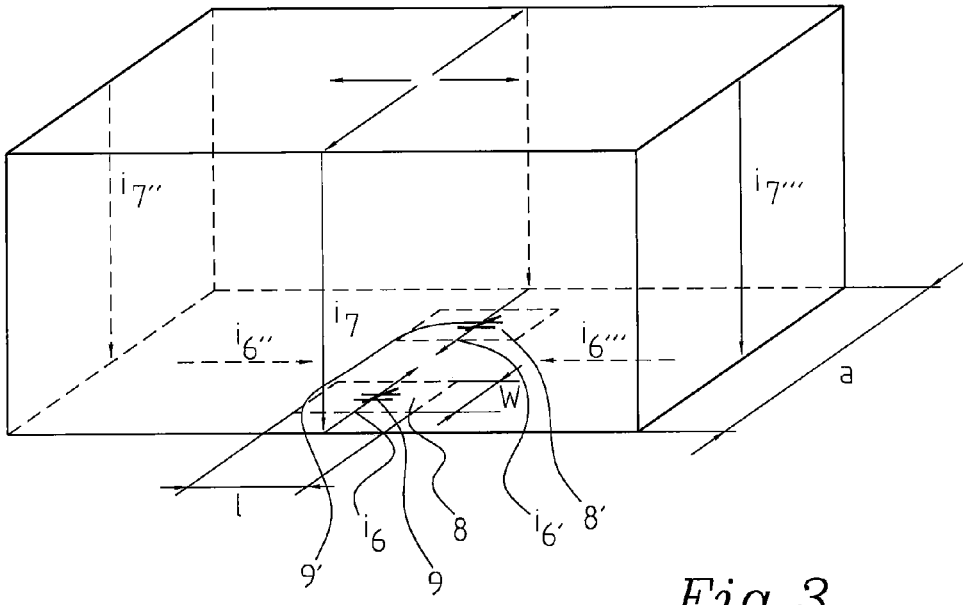
FIG. 3 illustrates the surface mounted waveguide of FIG. 2 with tunable elements in the bottom wall.

FIG. 3 is a figure similar to FIG. 2 but illustrates slots 8, 8' provided in the bottom wall (conducting layer 3) which are continently opened to cut the paths of the currents $I_{6''}$ and $I_6$ respectively. In an alternative embodiment slots may be provided to cut the currents $I_{6''}$ and $I_{6'''}$. Still further slots may be provided to cut all currents $I_6$-$I_{6'''}$. Variable capacitors or varactors 9, 9' are provided or connected in the slots 8, 8' respectively to allow currents to flow through them to a controllable extent. These capacitors 9, 9' may comprise chips, for example MEM (Micro-electro mechanical) or semiconductor devices etc. In another implementation the capacitors are formed as an integral part of the layered structure, for example layered structure 20 of FIG. 1. Thus, there are several different implementations of varactors which fall within the scope of the present invention, as integrated or discrete, standalone components.

Figure 4:
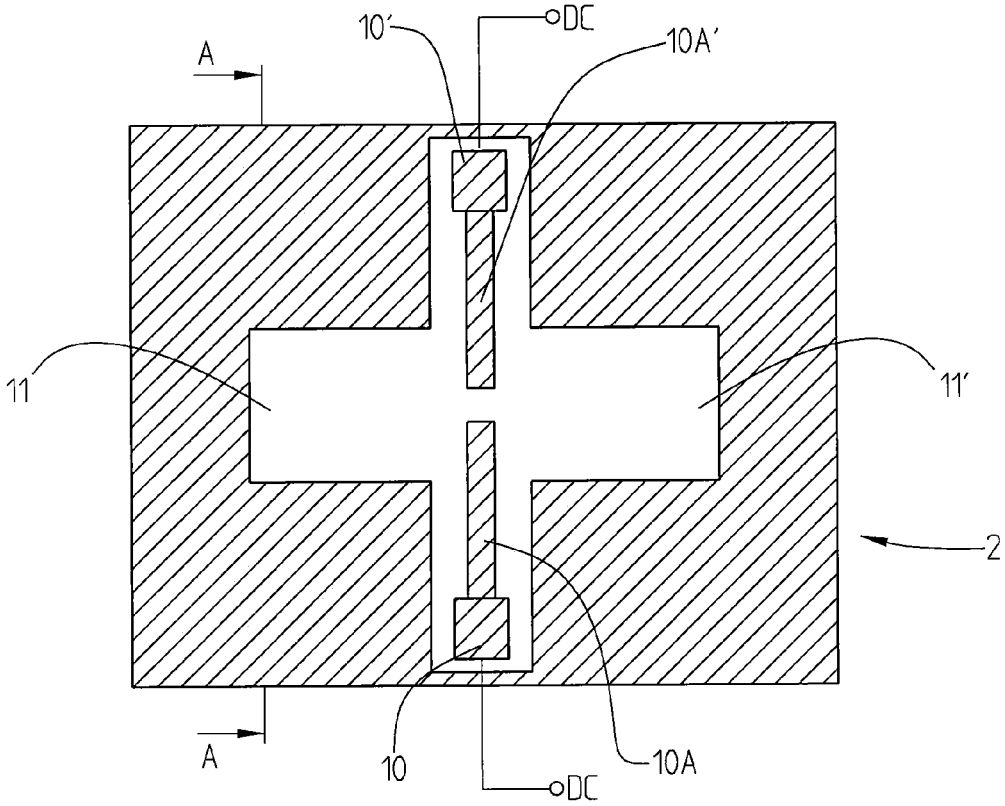
FIG. 4 illustrates a proximate conducting layer to be disposed on the substrate of an arrangement as in FIG. 1.
Figure 4A:
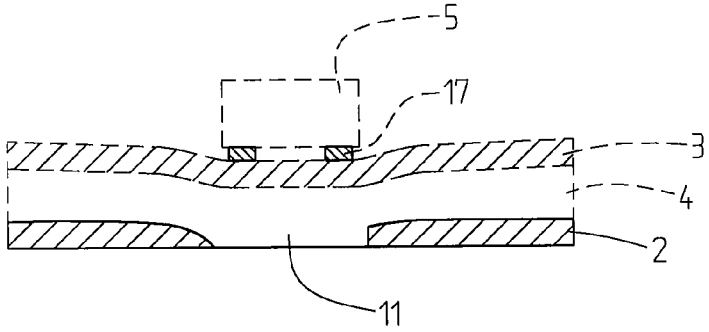
FIG. 4A is a cross-sectional view along lines A-A in FIG. 4A also showing further layers of the layered structure (dashed lines)
Figure 5:
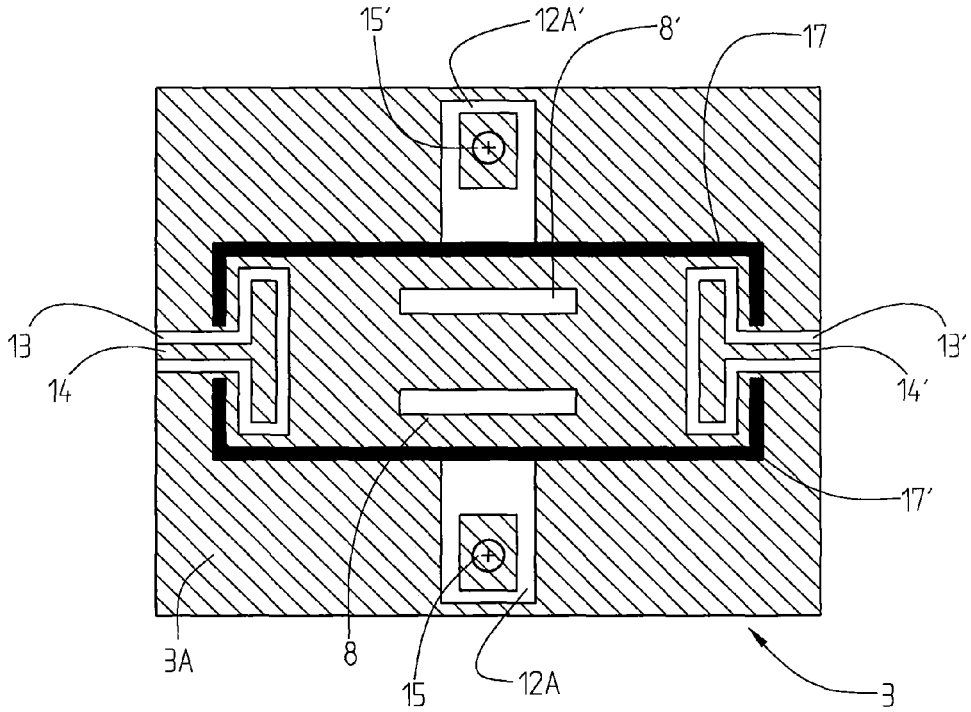
FIG. 5 illustrates the distant conducting layer forming the wall of the hollow waveguide resonator of the arrangement shown in FIG. 1, in a larger scale.

FIGS. 4, 4A and 5 show layers of a layered structure and the layered structure respectively with one particular implementation of integrated capacitors.

FIG. 4 schematically illustrates a first proximate conducting layer 2 and a patterning to provide such integrated capacitors. FIG. 4 is a top view of a patterned conducting layer 2 which comprises a cross-shaped recess or opening consisting of a rectangular opening with a first and a second portion 11, 11' respectively which in the centre is crossed by another rectangularly shaped opening, the centre of which in this embodiment crosses the first rectangular opening at the centre thereof. The width of the first rectangular opening portions is preferably larger than that of the second rectangularly shaped opening portions. The second opening preferably ends closer to the respective outer borders of layer 2 which here are orthogonal to the sides where the input and output coupling means may, but do not have to, be connected to the first or proximate metal conducting layer 3. Two metal conducting stripes 10A, 10A' with respective enlarged outer end portions 10, 10' facing the outer borders of layer 2 are provided in the second rectangular opening portions. They are aligned but not interconnected and there is a slight distance between them. A biasing control or tuning voltage can be applied to said outer end portions 10, 10'.

FIG. 4A is a cross-sectional view along the line A-A in FIG. 4. It is supposed that a first conducting layer 2 is disposed below a dielectric layer 4 and a second or distant conducting layer 3, the latter (3,4) here being indicated by dashed lines. It is also supposed that a surface mounted waveguide 5 is mounted such that the upper surface of conducting layer 3 forms its bottom wall. The dielectric layer 4 is arranged above the conducting layer 2 and dielectric material may also be disposed in the opening 11, 11'. Solder pads 17, 17', as will be more thoroughly described with reference to FIG. 5, are deposited on the top surface of conducting layer 3. The solder pads provide the particular advantage of facilitating for arranging or placing the hollow waveguide 5 on the conducting layer 3 through self alignment. It should be clear that FIG. 4A is very schematical and therefore has no limiting effects, neither as far as relations between thicknesses and sizes of layers, nor as far as the absolute values thereof, are concerned.

FIG. 5 schematically illustrates the second, distant, conducting layer 3 and how it can be patterned according to a first advantageous embodiment. Input and output coupling means for microwave signals, i.e. for coupling microwave signals into and out of the tunable microwave arrangement, here a resonator, are formed by means of one another facing T-shaped slots, 13, 13' in which strips 14, 14' of a similar but smaller size are arranged to form coplanar waveguides adapted to act as coupling means. Two elongated openings or recesses 8, 8' are arranged as schematically illustrated in FIG. 3 perpendicularly to the T-shaped slots, to cut generated surface currents as discussed earlier in the application. The T-shaped slots 13, 13' are provided at locations which substantially correspond to the location of the respective outer parts of openings or recesses 11, 11' in the first conducting layer 2 as shown in FIG. 4. In opening 12A, 12A' respective connecting metal strips 12, 12' are located. The openings 12A, 12A' are rectangular and arranged orthogonally to the T-shaped slots 13, 13' at locations substantially corresponding to the outer ends of the thinner cross-legs opening portions of layer 2. The conducting layer 3 can be said to consist of a main conductive portion 3A and strips 12, 12' arranged in openings or recesses 12A, 12A' and T-shaped strips 14, 14' arranged in somewhat larger T-shaped recesses 13, 13'. In main portion 3A also current regulating or current cutting openings 8, 8' are provided in an appropriate manner depending on which surface currents are to be cut. Two solder pads 17, 17', cf. FIG. 4A, are deposited on top of the metal layer 3 to facilitate self-alignment at positioning of the hollow waveguide 5.

Figure 6:
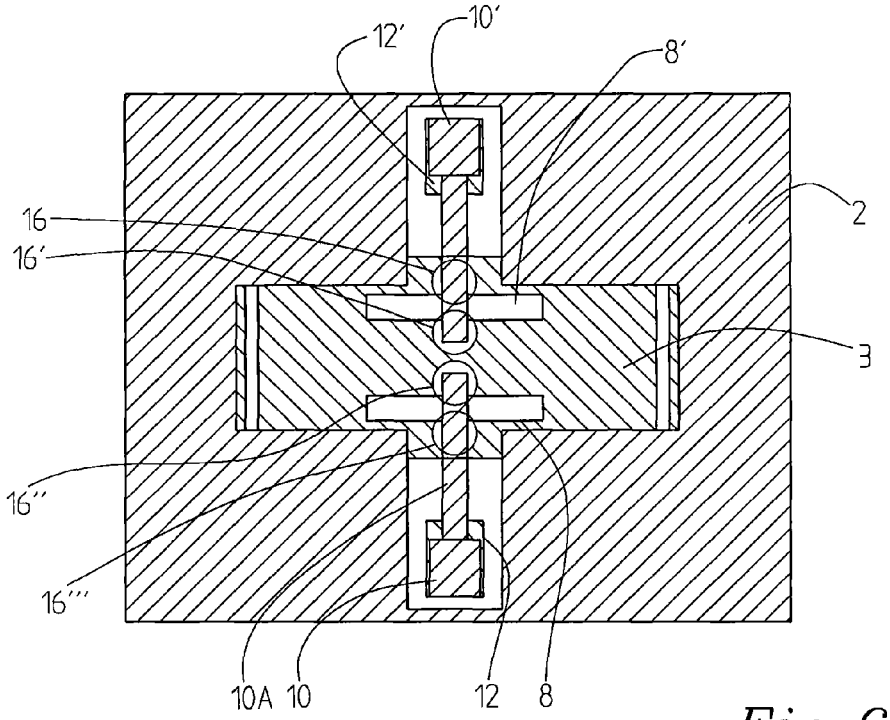
FIG. 6 is a view from below of the layered structure shown in FIG. 1.

FIG. 6 is a schematical view of a layered structure with conducting layers 2, 3 from below, i.e. seen from the substrate 1. Metallic vias 15, 15' (see FIG. 5) are provided at locations corresponding to strips 12, 12' (layer 3) and enlarged portion 10, 10' (in layer 2) in order to galvanically connect the first and the second conducting layers 2, 3. Ferroelectric varactors 16, 16', 16", 16'" are formed at the interfaces where the metal layers 2, 3 overlap by means of strips 10A, 10A', (layer 2) and the main portion 3A where the strips cross openings or recesses 8, 8' in layer 3.

Figure 7:
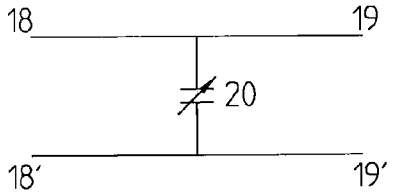
FIG. 7 is a circuit diagram showing the equivalent circuit of an arrangement as in FIG. 1.

FIG. 7 is a simple equivalent circuit explaining the functioning of the arrangement according to the invention. The terminals 18, 18' represent strip 14 and the main portion 3A of layer 3 separated by slot 13. Correspondingly terminals 19 and 19' represent strip 14' and main portion 3A of the conducting layer separated by slot 13'. Terminals 18, 18' and 19, 19' form input/output ports, i.e. the microwave input and output coupling means. In FIG. 7 the waveguide arrangement 100 is represented as a section of an equivalent two-wire transmission line loaded by a capacitor 20. The capacitor 20 represents varactors 9, 9' in FIG. 3 corresponding to varactors 16, 16', 16", 16'" in FIG. 6. The electromagnetic waves input at the input coupling means propagate in the waveguide arrangement and the parameters of the propagating waves can be controlled by varying the capacitance of the capacitor 20. The capacitance is controllable, variable, by means of application of a DC voltage between strips 12, 12' and the main portion 3A of the conducting layer 3. The DC voltage is particularly applied to conducting layer 2, to portions 10, 10', cf. FIG. 4. It can alternatively be applied to layer 3 at any appropriate location.

Figure 8:
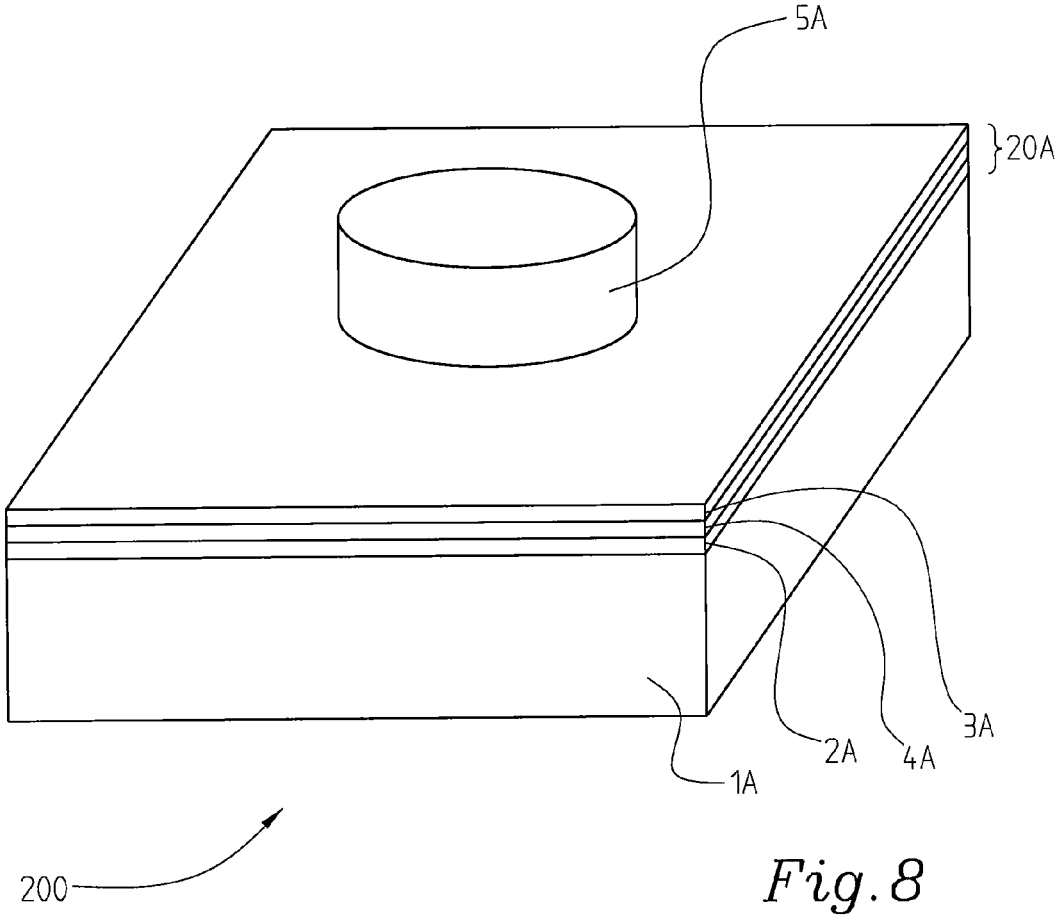
FIG. 8 illustrates a second embodiment of a tunable microwave arrangement.

FIG. 8 is a schematical illustration of an alternative embodiment showing a microwave arrangement 200 with a substrate 1A on which a layered structure 20A is provided. Also in this environment the layered structure 20A comprises three layers, a first, proximate, conducting layer 2A and a second, distant, conducting layer 3A between which a dielectric layer 4A is sandwiched. The distant, here top, conducting layer 3A forms the bottom wall of a surface mounted hollow waveguide 5A which in this case is circular. This embodiment is schematically illustrated in order to show that the invention is not limited to square-shaped or rectangular surface mounted waveguides.

Figure 9:
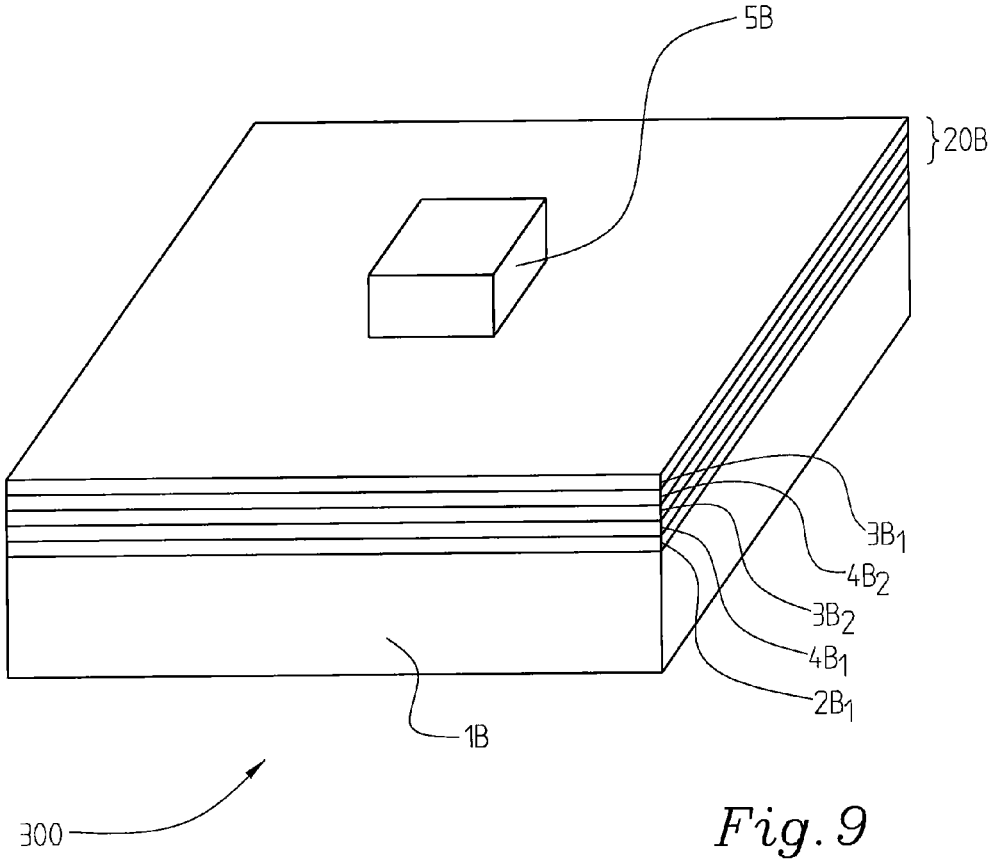
FIG. 9 illustrates a third embodiment of a tunable microwave arrangement.

FIG. 9 shows still another implementation of a waveguide arrangement 300 according to the present invention. It comprises a substrate 1B on which a layered structure 20B is disposed. The layered structure 20B here comprises a first proximate, conducting layer 2$B_1$ disposed on the substrate, on which is disposed a dielectric layer 4$B_1$, on top of which a first distant conducting layer 3$B_2$ is disposed. On top thereof is a second dielectric layer 4$B_2$, on which there is a second distant conducting layer 3$B_1$ which is adapted to form the bottom wall of a surface mounted waveguide 5B. The surface mounted waveguide here is square-shaped although it could also have had any other appropriate form. It should be clear that there can also be more layers included in the layered structure 20B, as also in any of the other embodiments.

Figure 10:
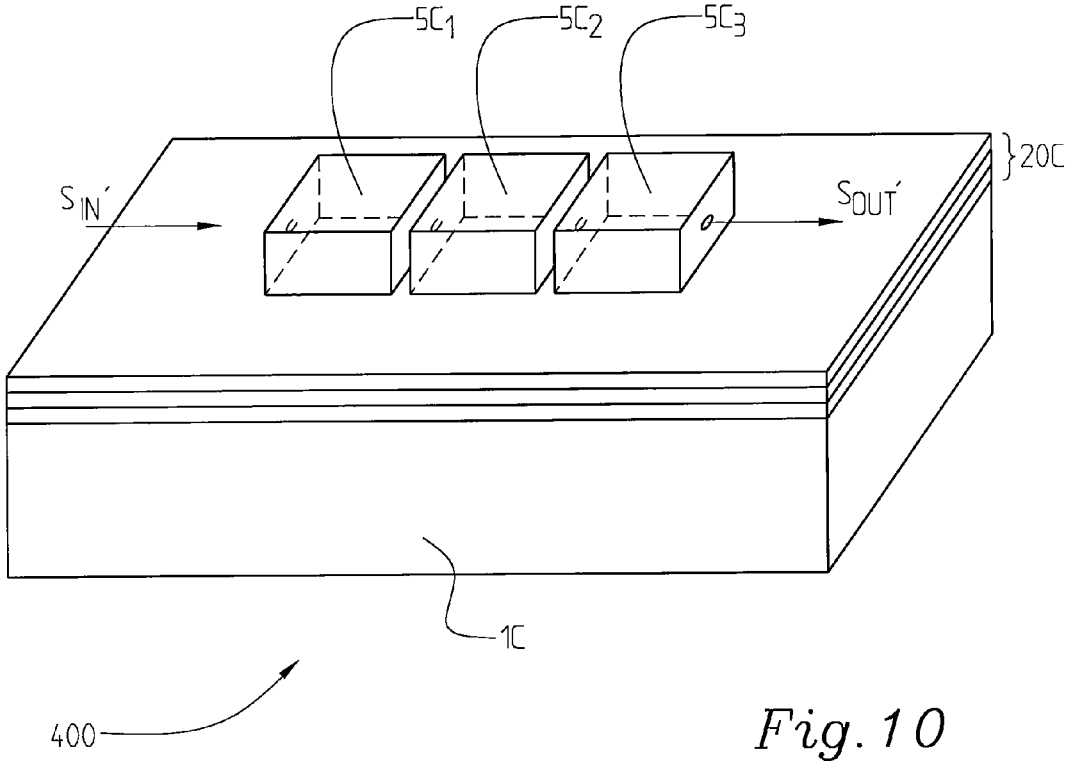
FIG. 10 illustrates a fourth embodiment of a tunable microwave arrangement comprising a filter.

FIG. 10 shows still another embodiment of a microwave arrangement 400 which comprises a filter, particularly a multi-pole filter. On top of a substrate 1C a layered structure 20C is provided which may comprise three, or more, layers arranged in an alternating manner. A conducting layer is provided adjacent to the substrate 1C. Another conducting layer is provided as an uppermost layer of the layered structure which forms the bottom wall of a plurality of surface mounted waveguides or resonators 5$C_1$, 5$C_2$, 5$C_3$ which are connected in cascade. These surface mounted waveguides 5$C_1$, 5$C_2$, 5$C_3$ are here interconnected by means of irises. They can also be interconnected in other appropriate manners. $S_{IN'}$ and $S_{OUT'}$ schematically illustrate input/output of a microwave signal. Tuning elements (not shown in FIG. 10) are provided by means of integrated varactors (or varactors provided for in any other appropriate manner as discussed above). The tuning elements are provided in the waveguide bottom wall which is formed by said uppermost conducting layer. It should be clear that the invention is not limited to provisioning of one or three surface mounted waveguides. It could be two or any other appropriate number arranged in cascade to form a filter. It should also be clear that the shape of the surface mounted waveguides can be different from what is shown herein.

Figure 11:
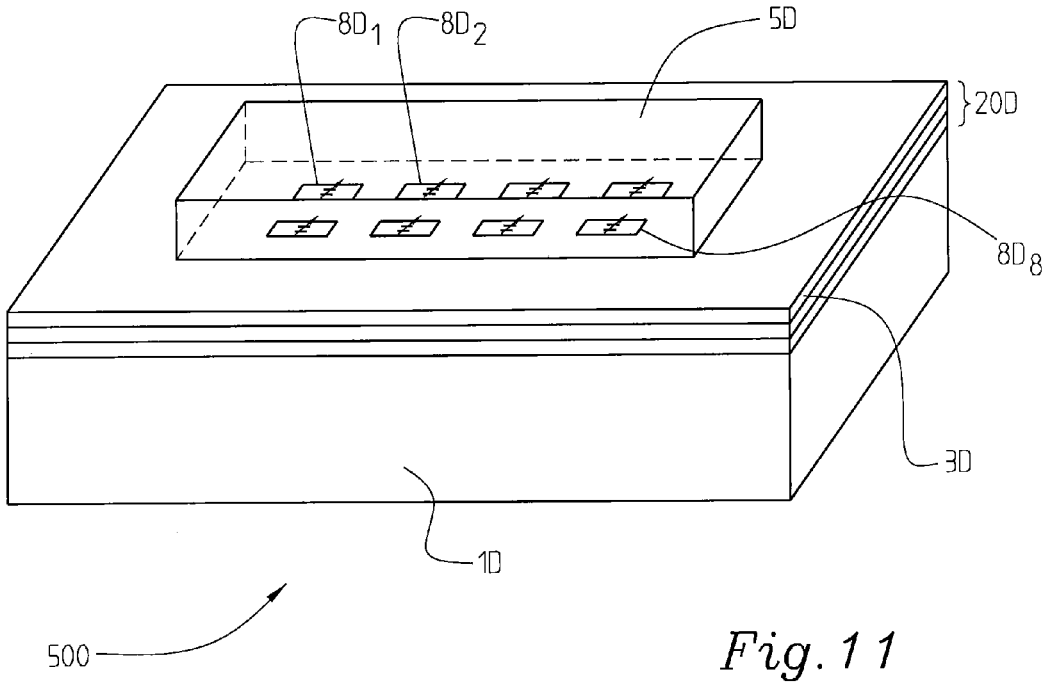
FIG. 11 illustrates a fifth embodiment of an arrangement according to the invention comprising a phase shifter or a delay line.

FIG. 11 shows still another embodiment of a tunable microwave arrangement 500 which comprises a substrate 1D on top of which a layered structure 20D is arranged. For reasons of simplicity the layered structure 20D is here illustrated as comprising three layers with a top or distant conducting layer 3D forming the bottom wall of a surface mounted waveguide 5D. The waveguide 5D has a longitudinal extension which considerably exceeds its transverse extension and a plurality of tuning elements 8$D_1$, 8$D_2$, . . . , 8$D_8$, are regularly arranged in said longitudinal extension. The tuning elements comprise varactor arrangements provided as discussed earlier (integrated or separate) in the top conducting layer/bottom wall. In still other embodiments there are more or fewer tuning elements comprising varactors. Of course such an embodiment is not restricted to the longitudinal extension considerably exceeding the transverse extension although, if there are to be a considerable number of tunable elements arranged in one direction, the length of that direction normally has to exceed the length of the other direction. The waveguide arrangement may comprise a phase shifter or a delay line. The longitudinal waveguide is here periodically loaded with varactors. Input and output coupling means are not illustrated but could be of any appropriate kind as discussed above.

Figure 12:
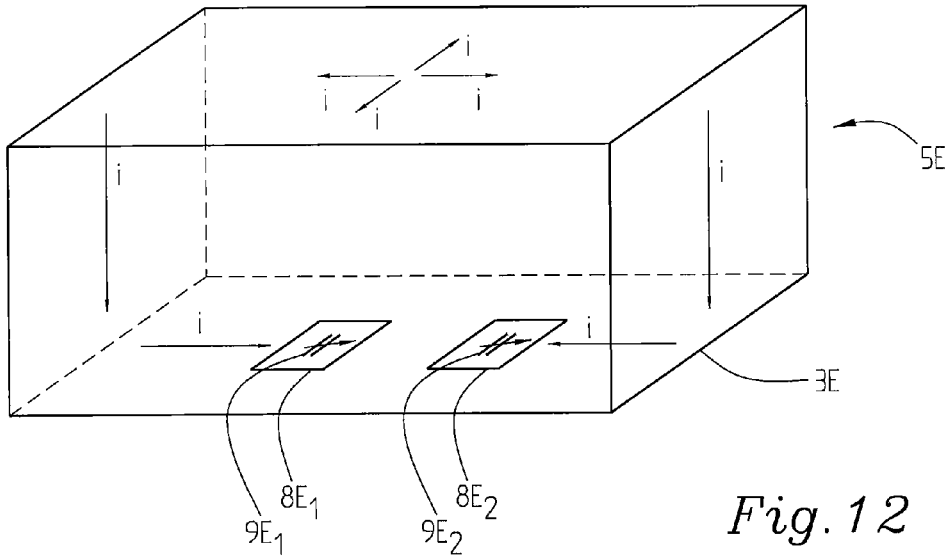
FIG. 12 illustrates a waveguide with tuning elements in a wall according to a sixth embodiment.

FIG. 12 very schematically illustrates a surface mounted waveguide arrangement 5E for which a top or distant conducting layer 3E (only schematically indicated) of a layered structure forms the bottom wall. The other layers of the layered structure, the substrate and the extension thereof, are not shown in this figure but these features have been extensively discussed with reference to the previous embodiments. The difference is that in FIG. 12 current cutting/interrupting slots are disposed in a different manner, intended to cut the currents i shown in the figure. Slots 8$E_1$, 8$E_2$ are disposed in parallel in the transverse direction of the rectangular waveguide. Variable capacitors 9$E_1$, 9$E_2$ are provided by means of the slots to allow a controllable amount of current to flow across the slots in the waveguide bottom wall formed by the conducting layer. As discussed earlier in the application, slots can be disposed in different manners to cut different currents, also orthogonally to one another.

It should be clear that in all embodiments the substrate can be made of different materials and for example comprise a PCB (Printed Circuit Board) e.g. of PVDF (Polyvinylidene Fluoride) or a polymer, silicon or a GaAs substrate. Microwave input/output means can be provided in different manners. The slots or openings arranged in the distant conducting layer and intended to cut surface currents can also be arranged in different manners, the purpose being to load, or put a varactor inside part of the cavity, or load the waveguide.

The number of, dimensions, shapes and sizes of the slots can be selected in any appropriate manner. In particular embodiments the slots or holes are rectangular within a length l which is smaller than half the wavelength of the microwaves, $\lambda/2$, and a width which is smaller than or equal to $\alpha/2$, wherein $\alpha$ is the width of the waveguide, cf. FIG. 3. Generally these dimensions, w,l are a trade-off between the Q-factor on one hand and the tunability on the other hand. Generally, the smaller the slots, l or w, the higher the Q-factor and the lower the tunability, whereas, the larger the slots, the higher the tunability and the lower the Q-factor. Thus, the dimensions are selected depending on whether a high tunability or a high Q-factor is most important.

In a particular embodiment the dielectric layer or layers comprises a complex metal oxide, at least where the slots are located. In other parts it may be dielectric, e.g. of another material. The complex metal oxide may comprise a ferroelectric, liquid crystal or a pyrochlore complex oxide. The conducting layers are preferably electrically isolated.

Figure 13:
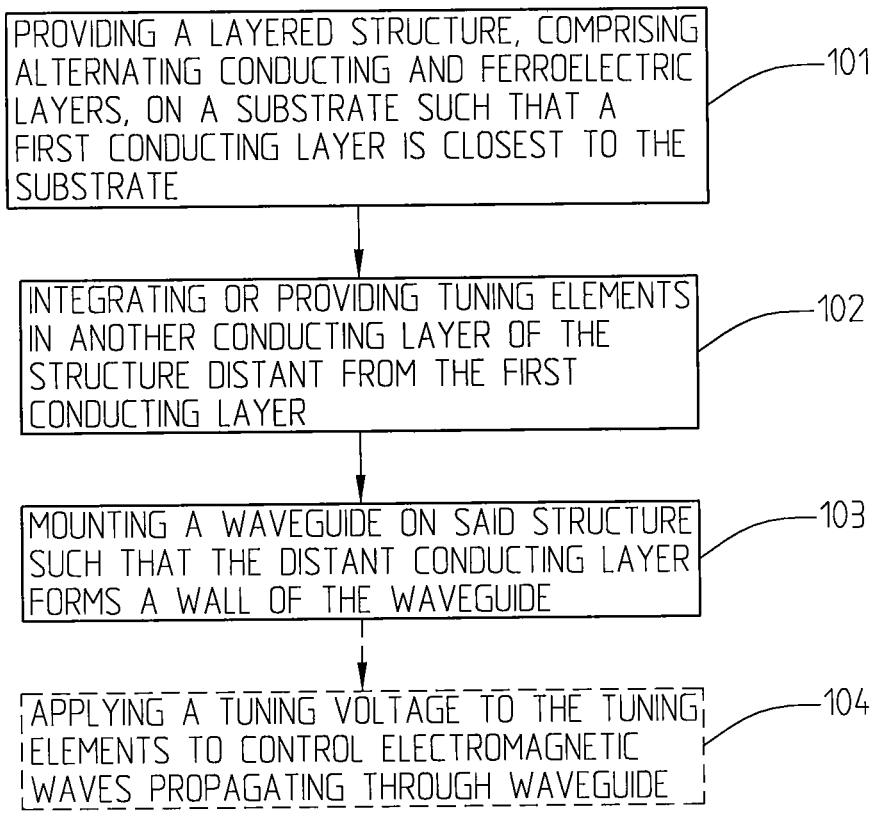
FIG. 13 is a flow diagram describing a method according to the invention for providing a tunable microwave arrangement.

FIG. 13 schematically illustrates a method according to the present invention for providing a tunable microwave arrangement according to the present invention. It is supposed that a layered structure, comprising alternating conducting and ferroelectric layers, is provided on a substrate such that a first conducting layer is disposed closest to the substrate, 101. It should be clear that the layers or the ferroelectric layer alternatively may be a liquid crystal or a pyrochlore complex oxide or more generally a complex metal oxide as discussed above, at least at the locations where the tuning elements are formed or provided. The tuning elements are provided, either as separate tuning elements, or integrated in another conducting layer of the structure which is distant from the substrate, 102. Then a waveguide, particularly, but not necessarily, a hollow waveguide, is provided on said structure such that the distant conducting layer forms a wall, bottom wall, of that waveguide, 103. To the hence fabricated waveguide arrangement, a tuning voltage is applied to the tuning elements to control electromagnetic waves propagating through the waveguide, 104, illustrated by means of dashed lines since it does not form part of the fabrication method itself.

It should be clear that the invention is not limited to the explicitly illustrated embodiments, but that it can varied in a number of ways within the scope of the appended claims.

The invention claimed is:

1. A microwave arrangement comprising:

a substrate;

a waveguide arrangement;

and tuning elements comprising a number of varactors for tuning an electromagnetic signal input to the waveguide arrangement, wherein the waveguide arrangement comprises (i) a layered structure comprising at least two conducting layers and at least one dielectric layer which are arranged in an alternating manner, and (ii) at least one surface mounted waveguide, wherein a second of said conducting layers being adapted to form a wall of the surface mounted waveguide which wall is adapted to incorporate said tuning elements which are arranged to enable control of surface currents generated in said waveguide wall, hence loading the waveguide with a tunable, controllable impedance, wherein said layered structure is arranged on the substrate such that a first of said conducting layers is closest to said substrate, that the second conducting layer that is adapted to form a wall of the surface mounted waveguide is most distant from the substrate and comprises slots located and shaped to cut or affect surface currents generated in said wall by the input electromagnetic signal, and that in said varactors are provided or connected in said slots, that the first conducting layer is pre-patterned and comprises a cross-shaped recess or an opening, in which two stripes are located, at a position corresponding to the position on the second, distant, conducting layer adapted to receive the surface mounted waveguide, and that the cross-shaped recess or opening has dimensions slightly smaller than the dimensions of the portion of the second conducting layer adapted to form the waveguide wall, that said two stripes are aligned and arranged at a slight distance from one another, and have respective enlarged outer end portions facing the outer borders of the first conducting layer and adapted to receive a biasing control or tuning voltage, that the second conducting layer consists of a main conductive portion, and stripes arranged in openings or recesses and T-shaped stripes arranged in T-shaped recesses that are arranged to act as microwave input/output coupling means, wherein the openings or recesses with the stripes are arranged orthogonally to the T-shaped recesses at locations substantially corresponding to the locations of the enlarged outer end portions of the stripes of the first conducting layer, and that the varactors are formed at overlapping areas between said stripes of the first conducting layer and the second conducting layer at the interfaces of said current cutting slots, that said first and second conducting layers are interconnected by vias or similar, and that the dielectric layer includes a complex metal oxide at least in areas corresponding to pre-patterned areas adapted to form or include the varactors in the second most distant conducting layer.

2. The microwave arrangement according to claim 1, wherein the at least one surface mounted waveguide is mounted on the second of said conducting layers.

3. The microwave arrangement according to claim 2, wherein the second of said conducting layers is arranged on the dielectric layer, the second of said conducting layers having a shape corresponding to the dielectric layer.

4. The tunable microwave arrangement according to claim 1, wherein the complex metal oxide includes a ferroelectric material, a liquid crystal or pyrochlore.

5. The tunable microwave arrangement according to claim 1, wherein the slots have a length or largest dimension $l \leq \lambda/2$, $\lambda$ being the wavelength of propagating electro-magnetic waves in the waveguide propagating electro-magnetic waves.

6. The tunable microwave arrangement according to claim 1, wherein the waveguide arrangement includes a plurality of surface mounted waveguides or resonators connected in cascade and that the tuning elements are provided in the respective waveguide bottom wall formed by said upper or distant conducting layer, and wherein the waveguide arrangement includes a filter.

7. The tunable microwave arrangement according to claim 1, wherein the waveguide has a longitudinal extension which considerably exceeds a transversal extension, wherein a plurality of tuning elements are regularly arranged in said longitudinal extension, and wherein the waveguide arrangement includes a phase shifter or a delay line.

8. A method for providing a microwave arrangement including a waveguide arrangement and tuning elements for tuning electromagnetic an electromagnetic signal input to the waveguide arrangement, and wherein the waveguide arrangement comprises (i) a layered structure comprising at least two conducting layers and at least one dielectric layer which are arranged in an alternating manner, and (ii) at least one surface mounted waveguide, wherein a second of said conducting layers forming a wall of the surface mounted waveguide which wall incorporates said tuning elements which are arranged to enable control of surface currents generated in said waveguide wall, hence loading the waveguide with a tunable, controllable impedance, the method comprising the steps of:

providing the layered structure comprising the at least two conducting layers and the at least one dielectric layer on a substrate and placing a first of said conducting layers closest to the substrate;

arranging the second conducting layer so that it forms a wall of the surface mounted waveguide and placing it most distant from the substrate and locating and shaping slots therein to cut or affect surface currents generated in said wall by the input electromagnetic signal, whereby said varactors are provided or connected in said slots;

pre-patterning the first conducting layer and make it include a cross-shaped recess or an opening in which two stripes are located at a position corresponding to the position on the second, distant, conducting layer receiving the surface mounted waveguide, and so that the cross-shaped recess or opening has dimensions slightly smaller than the dimensions of the portion of the second conducting layer forming the waveguide wall;

aligning and arranging two stripes at a slight distance from one another, which stripes have respective enlarged outer end portions facing the outer borders of the first conducting layer and adapted to receive a biasing control or tuning voltage, that the second conducting layer consists of a main conductive portion, and stripes arranged in openings or recesses and T-shaped stripes arranged in T-shaped recesses, and being arranged to act as microwave input/output coupling means, wherein the openings or recesses with the stripes are arranged orthogonally to the T-shaped recesses at locations substantially corresponding to the locations of the enlarged outer end portions of the stripes of the first conducting layer, the varactors being formed at overlapping areas between said stripes of the first conducting layer and the second conducting layer at the interfaces of said current cutting slots, interconnecting said first and second conducting layers by vias or similar, and wherein the dielectric layer comprises a complex metal oxide at least in areas corresponding to pre-patterned areas forming or comprising the varactors in the second most distant conducting layer.

9. The method according to claim 8, wherein the at least one surface mounted waveguide is mounted on the second of said conducting layers.

10. The method according to claim 9, wherein the second of said conducting layers is arranged on the dielectric layer, the second of said conducting layers having a shape corresponding to the dielectric layer.

11. The method according to claim 8, wherein the step of providing tuning elements further comprises:

selecting the dimensions of the slots, depending on tunability and quality factor requirements, and such that the longitudinal extension of each slot is smaller than or equal to $\lambda/2$, $\lambda$ being the wavelength of the propagating electromagnetic waves.

* * * * *